US005357084A

United States Patent [19]

McKee et al.

[11] Patent Number: 5,357,084

[45] Date of Patent: Oct. 18, 1994

[54] DEVICE FOR ELECTRICALLY INTERCONNECTING CONTACT ARRAYS

[75] Inventors: Michael J. McKee, New Cumberland; Joseph M. Pawlikowski, Lancaster, both of Pa.

[73] Assignee: The Whitaker Corporation, Wilmington, Del.

[21] Appl. No.: 152,645

[22] Filed: Nov. 15, 1993

[51] Int. Cl.[5] ..... H05B 6/10

[52] U.S. Cl. ..... 219/605; 219/616; 219/633; 29/860; 174/88 R; 439/507; 439/511

[58] Field of Search ..... 219/603, 605, 616, 633; 29/843, 857, 860; 174/88 R; 439/507, 511, 509

[56] References Cited

U.S. PATENT DOCUMENTS

| | | | |
|---|---|---|---|
| 4,085,502 | 4/1978 | Ostman et al. | 29/843 |
| 4,256,945 | 3/1981 | Carter et al. | 219/10.75 |
| 4,470,195 | 9/1984 | Lang | 29/825 |
| 4,554,033 | 12/1985 | Dery et al. | 156/52 |
| 4,588,456 | 5/1986 | Dery et al. | 156/52 |
| 4,623,401 | 12/1986 | Derbyshire et al. | 148/13 |
| 4,626,767 | 12/1986 | Clappier et al. | 323/280 |
| 4,640,981 | 2/1987 | Dery et al. | 174/88 R |
| 4,642,421 | 2/1987 | Dery et al. | 174/88 R |
| 4,647,323 | 3/1987 | Darstein et al. | 156/50 |
| 4,659,912 | 4/1987 | Derbyshire | 219/535 |
| 4,695,713 | 9/1987 | Krumme | 219/553 |
| 4,701,587 | 10/1987 | Carter et al. | 219/10.75 |
| 4,717,814 | 1/1988 | Krumme | 219/553 |
| 4,745,264 | 5/1988 | Carter | 219/553 |
| 4,789,767 | 12/1988 | Doljack | 219/9.5 |
| 4,795,870 | 1/1989 | Krumme et al. | 219/9.5 |
| 4,852,252 | 8/1989 | Ayer | 29/860 |
| 4,990,736 | 2/1991 | Henschen et al. | 219/10.75 |
| 4,995,838 | 2/1991 | Ayer et al. | 439/874 |
| 5,030,137 | 7/1991 | Bernhardt | 439/492 |
| 5,032,703 | 7/1991 | Henschen et al. | 219/85.22 |
| 5,059,756 | 10/1991 | Henschenp et al. | 219/85.22 |
| 5,064,978 | 11/1991 | Scholz | 219/605 |
| 5,065,501 | 11/1991 | Henschen et al. | 29/611 |
| 5,090,116 | 2/1992 | Henschen et al. | 29/827 |

FOREIGN PATENT DOCUMENTS 241597 10/1987 European Pat. Off. .

OTHER PUBLICATIONS

Flexible Film Products, AMP Catalog 82007–Revised Oct. 1993, pp. 84–86.

*Primary Examiner*—Philip H. Leung
*Attorney, Agent, or Firm*—Katherine A. Nelson

[57] ABSTRACT

The jumper cable assembly 10 in accordance with the invention includes at least a first layer 12 of insulating film, an array of electrical conductors 20, each having first and second connecting portions 22,24 at opposed ends thereof and a fusible electrically conductive material disposed on the connecting portions 22,24. Each conductor 20 is formed from a first conductive layer 26 having high electrical resistance and high magnetic permeability, and a second conductive layer 28 integrally joined thereto, the second layer having low electrical resistance and minimal magnetic permeability. Each of the conductors 20 defines a heater body. Upon disposing the corresponding arrays of the first and second connecting portions 22,24 over corresponding contact pads 54,64 of the first and second electrical articles 50,60 and upon subjecting the heater bodies to the constant current of known frequency, each heater body generates and transfers sufficient thermal energy to the connecting portions to melt the fusible material thereby effecting electrical and mechanical interconnection.

6 Claims, 5 Drawing Sheets

DEVICE FOR ELECTRICALLY INTERCONNECTING CONTACT ARRAYS

FIELD OF THE INVENTION

The present invention relates to a device for electrically interconnecting a first plurality of contact elements on a first electrical article to a second plurality of contact elements on a second electrical article, and more particularly to a jumper cable assembly for electrically interconnecting spaced apart arrays of contact elements on two electrical articles.

BACKGROUND OF THE INVENTION

U.S. Pat. No. 4,852,252 discloses providing each of the terminals of a connector with a thin layer of magnetic material along the surface of the nonmagnetic low resistance solder tail of the terminal facing sway from the surface to which a wire end will be soldered; in U.S. Pat. No. 4,995,838 a preform of foil having a magnetic layer is disclosed to be soldered to the terminal solder tail's wire-remote surface. The bimetallic structure uses the Curie temperature of the magnetic material to define an article which will generate thermal energy when subjected to radio frequency current of certain frequency for sufficient short length of time until a certain known temperature is achieved, above which the structure is inherently incapable of rising; by selecting the magnetic material and sufficient thickness thereof and selecting an appropriate solder, the temperature achieved can be selected to be higher than the reflow temperature of the solder preform; when the terminal is subjected through induction to RF current of the appropriate frequency, the solder tail will generate heat which will radiate to the solder preform, reflow the solder, and be conducted along the wire and the terminal and radiate further to shrink the tubing and melt the sealant material. The terminal thus includes an integral mechanism for enabling simultaneous soldering and sealing without other application of heat; excess heat is avoided as is the potential of heat damage to remaining portions of the connector or tubing.

Another U.S. Pat. No. 4,789,767 discloses a multipin connector whose contacts have magnetic material layers on portions thereof spaced from the contact sections to be surface mounted to respective traces on the surface of a printed circuit board. An apparatus is disclosed having a coil wound magnetic core having multiple shaped pole pieces in spaced pairs with an air gap therebetween within which the connector is placed during soldering. The pole pieces concentrate flux in the magnetic contact coating upon being placed beside the contact sections to be soldered, to transmit RF current to each of the contacts, generating thermal energy to a known maximum temperature to reflow the solder and join the contact sections to the conductive traces of the printed circuit element.

Such Curie point heating is disclosed in U.S. Pat. Nos. 4,256,945; 4,623,401; 4,659,912; 4,695,713; 4,701,587; 4,717,814; 4,745,264 and European Patent Publication No. 0241,597. When a radio frequency current for example is passed through such a bipartite structure, the current initially is concentrated in the thin high resistance magnetic material layer which causes heating; when the temperature in the magnetic material layer reaches its Curie temperature, it is known that the magnetic permeability of the layer decreases dramatically; the current density profile then expands into the non-magnetic substrate of low resistivity. The thermal energy is then transmitted by conduction to adjacent structure such as wires and solder which act as thermal sinks; since the temperature at thermal sink locations does not rise to the magnetic material's Curie temperature as quickly as at non-sink locations, the current remains concentrated in those portions of the magnetic material layer adjacent the thermal sink locations and is distributed in the low resistance substrate at non-sink locations. It is known that for a given frequency the self-regulating temperature source thus defined achieves and maintains a certain maximum temperature dependent on the particular magnetic material. One source for regenerating radio frequency current such as of 13.56 mHz is disclosed in U.S. Pat. No. 4,626,767.

The conductive substrate can be copper having a magnetic permeability of about one and a resistivity of about 1.72 micro-ohm-centimeters. The magnetic material may be for example a clad coating of nickel-iron alloy such as Alloy No. 42 (42% nickel, 58% iron) or Alloy No. 42-6 (42% nickel, 52% iron and 6% chromium). Typical magnetic permeabilities for the magnetic layer range from fifty to about one thousand, and electrical resistivities normally range from twenty to ninety micro-ohm-centimeters as compared to 1.72 for copper; the magnetic material layer can have a Curie temperature selected to be from the range of between about 200° C. to about 500° C., for example. The thickness of the magnetic material layer is typically one to two skin depths; the skin depth is inversely proportional to the square root of the product of the magnetic permeability of the magnetic material and the frequency of the alternating current passing through the two-layer structure. Solders can be tin-lead such as for example Sn 63 reflowable at a temperature of about 183° C. or Sb-5 reflowable at a temperature of about 240° C. Generally it would be desirable to select a Curie temperature of about 15° C. to 75° C. above the solder reflow temperature.

U.S. Pat. No. 5,059,756 discloses a self-regulating temperature heater with thermally conductive extensions that is used to solder a plurality of spaced contacts on one member with a corresponding plurality of contacts on a second member. The contacts on at least one of the members is either at an edge of member such as a circuit board or is along an outer edge of a connector such as surface mount contacts or exposed wires at the edge of a cable or the like. The heater uses a bimetallic structure similar to the ones disclosed in the previously discussed patents.

The use of jumper cables to interconnect a plurality of contact pads on one surface to a plurality of contact pads on another surface is known. Typically the jumper cable is made from two layers of flexible material having an array of metallic conductors laminated therebetween. End portions of the conductors project beyond the edge of the jumper cable for interconnection to other devices. One such example of the jumper cable is found in U.S. Pat. No. 4,085,502. Typically these jumper cables are soldered to corresponding conductors or contact pads on electrical articles by subjecting the devices to reflow solder or similar processes.

It is desirable to have a device suitable for use in electrically interconnecting two arrays of contact pads on two spaced apart electrical articles.

It is also desirable to eliminate the need to perform soldering in a process wherein all portions of the articles are subjected to the high temperatures requisite to reflow solder.

SUMMARY OF THE INVENTION

The present invention is directed to a jumper cable assembly for providing sufficient thermal energy to melt fusible conductive material, thereby electrically interconnecting a first array of contact pads on a surface of a first electrical article to a corresponding second array of contact pads of a second electrical article, the first and second electrical articles being spaced from one another. The jumper cable assembly is useable in conjunction with a source of constant amplitude high frequency alternating current of a known frequency.

The jumper cable assembly in accordance with the invention includes at least a first layer of insulating film, an array of electrical conductors disposed on the inner surface of the first film layer, each conductor having first and second connecting portions at opposed ends thereof and a fusible electrically conductive material disposed on the first and second connecting portions. Each conductor is formed from a first conductive layer adjacent the first film layer, the first layer being a first metal having high electrical resistance and high magnetic permeability, the first conductive layer having a thickness at least equal to one skin depth of the first metal, given the known frequency, and a second conductive layer of a second metal integrally joined to the first conductive layer, the second metal having low electrical resistance and minimal magnetic permeability. Each of the conductors thereby defines a heater body.

Alternatively, the conductors may be formed as a wire having a core of the second metal surrounded by an outer coating of the first metal. To enhance solderability, a layer of tin may be disposed on the exposed surfaces of the first and second connecting portions prior to disposing the fusible electrically conductive material thereon.

In another embodiment, a second layer of insulating film is laminated to the first film layer and over the array of the conductors adjacent the second conductive layer thereof such that the array of conductors lie between inner surfaces of the first and second film layers. The second film layer is shorter in length than the first film layer such that the second metal of the second layer of the first and second connecting portions of the conductors are exposed on the inner surface of the first film layer. Upon disposing the arrays of the first and second connecting portions of the conductors on corresponding contact pads of the first and second electrical articles with the second conductive layers adjacent respective contact pads of the first and second electrical articles, and upon subjecting the connecting portions or heater bodies to the constant current of known frequency, each the heater body generates and transfers sufficient thermal energy from the heater body to the connecting portions to melt the fusible material disposed therealong thereby electrically and mechanically interconnecting the conductors of the jumper cable assembly to corresponding contact pads of the respective first and second electrical articles.

Current to the heater body may be conducted directly from a constant amplitude alternating current source or may be induced as eddy currents in the heater body from an appropriately shaped conductor that is disposed over the connecting portions of the conductors or heater bodies.

Embodiments of the present invention will now be described in detail with reference to the accompanying drawings.

DETAILED DESCRIPTION OF THE DRAWINGS

Figure 1:
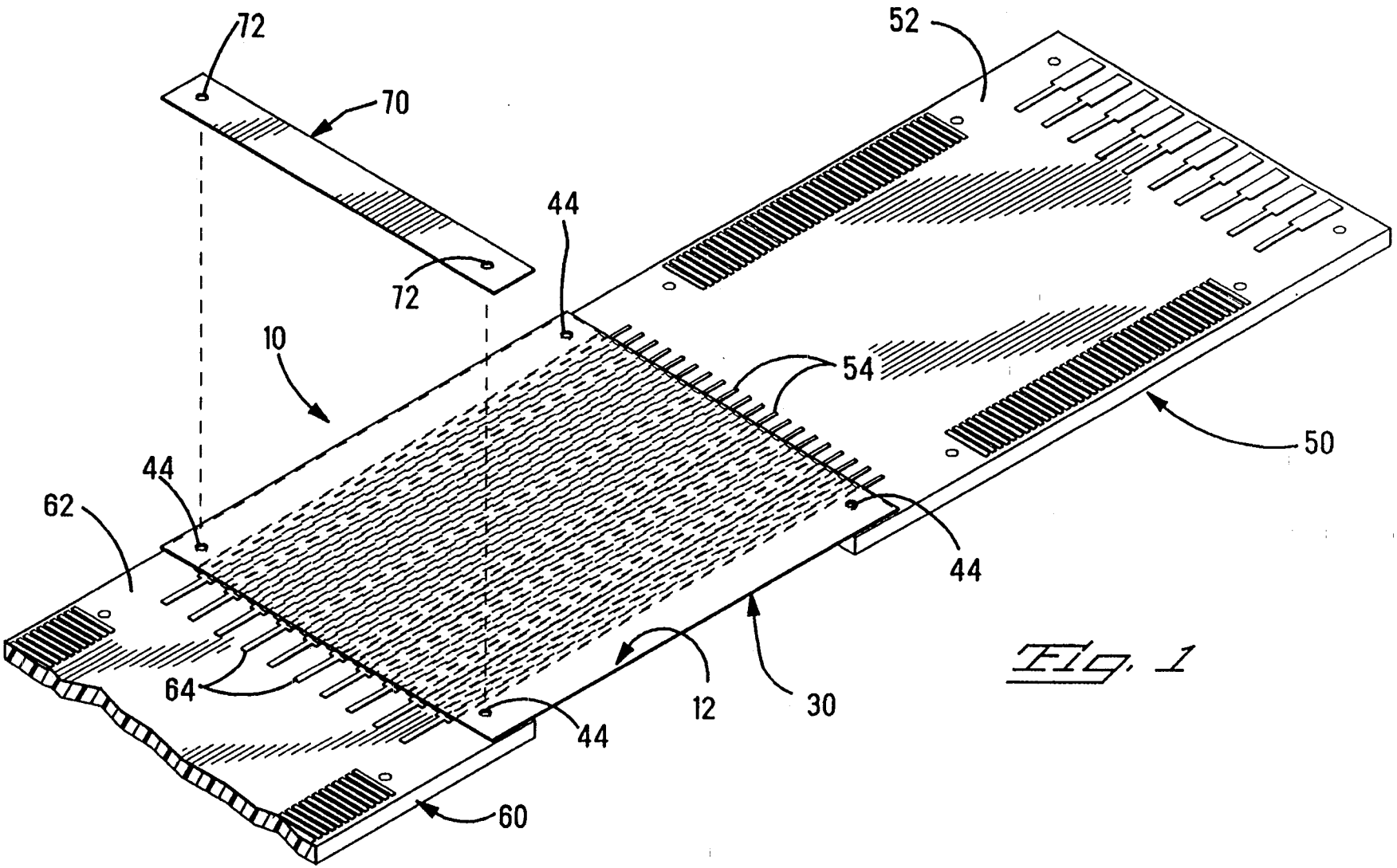
FIG. 1 is a perspective view of the jumper cable assembly of the present invention interconnecting contact pads on a first circuit board to corresponding contact pads on a second circuit board.
Figure 2:
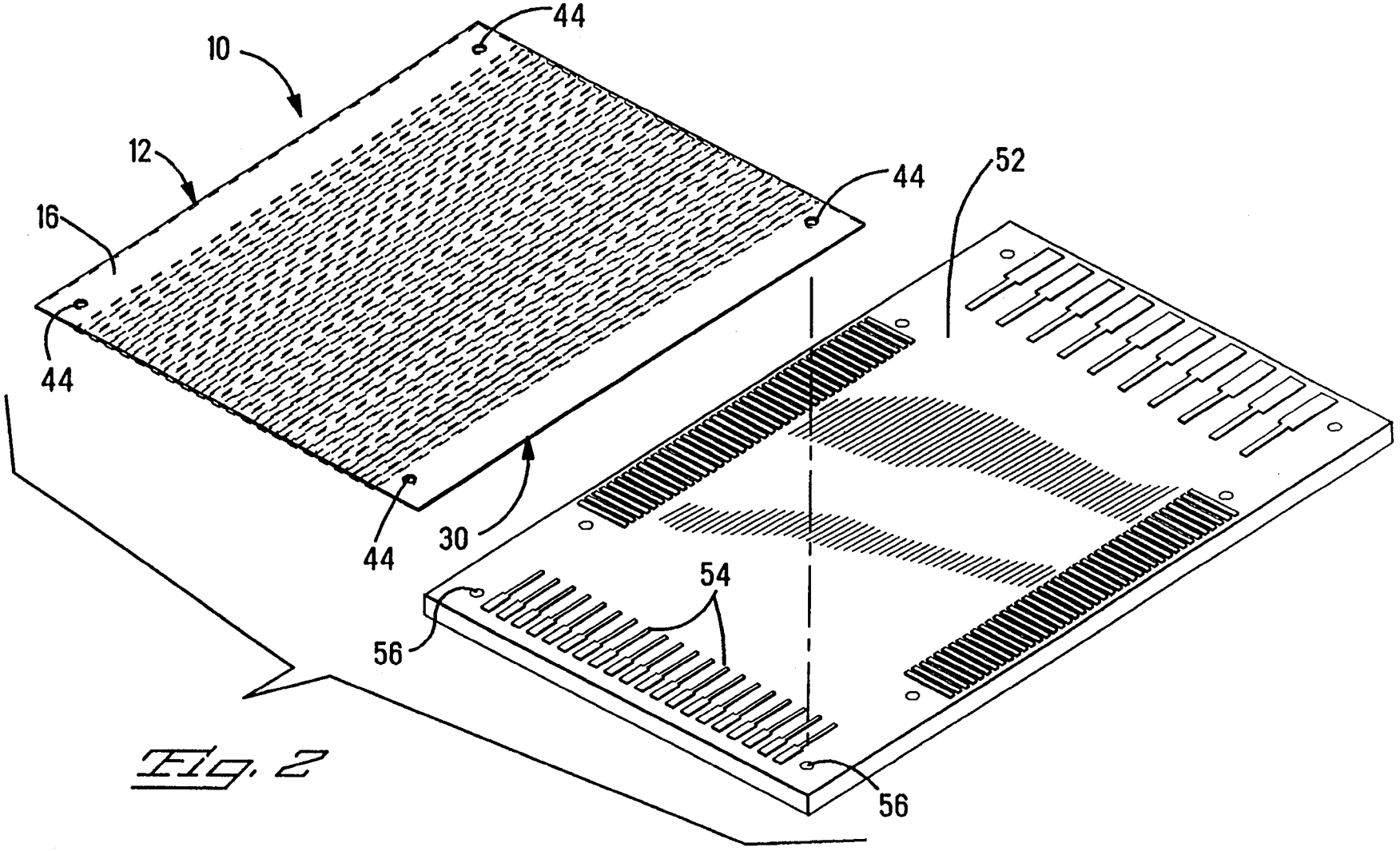
FIG. 2 is a perspective view of a jumper cable assembly exploded from one of the circuit boards of FIG. 1.

The jumper cable assembly 10 is usable in conjunction with a source of constant amplitude high frequency alternating current of a known frequency.

The jumper cable assembly 10 provides sufficient thermal energy to melt a fusible conductive material 40 to electrically interconnect a first array of contact pads 54 on a surface 52 of a first electrical article 50 to a corresponding second array of contact pads 64 on a surface 62 of a second electrical article 60, the first and second electrical article 50,60 being spaced from one another.

Figure 4:
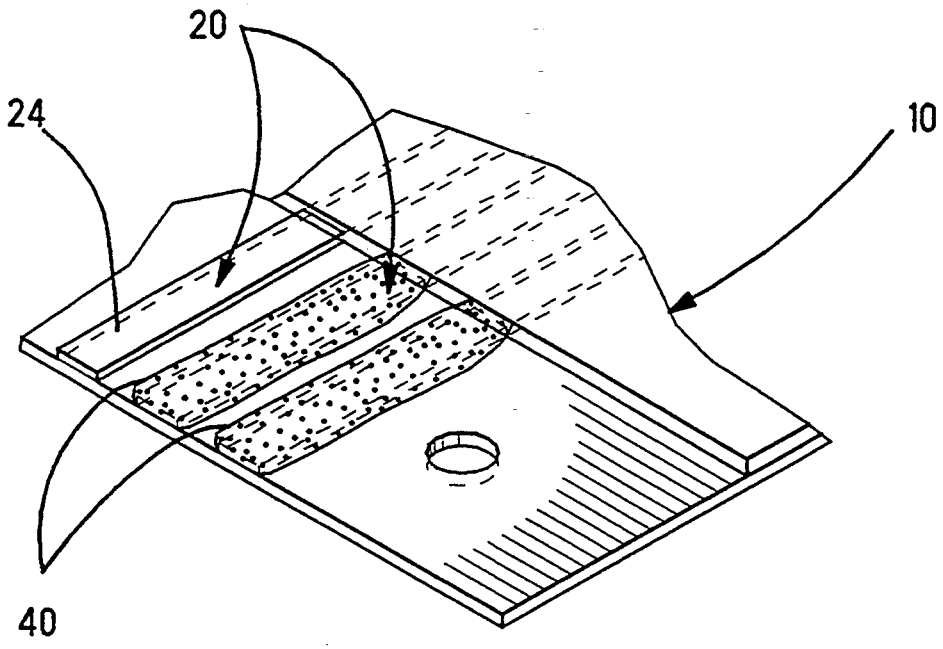
FIG. 4 is an enlarged fragmentary portion of FIG. 3.
Figure 5:
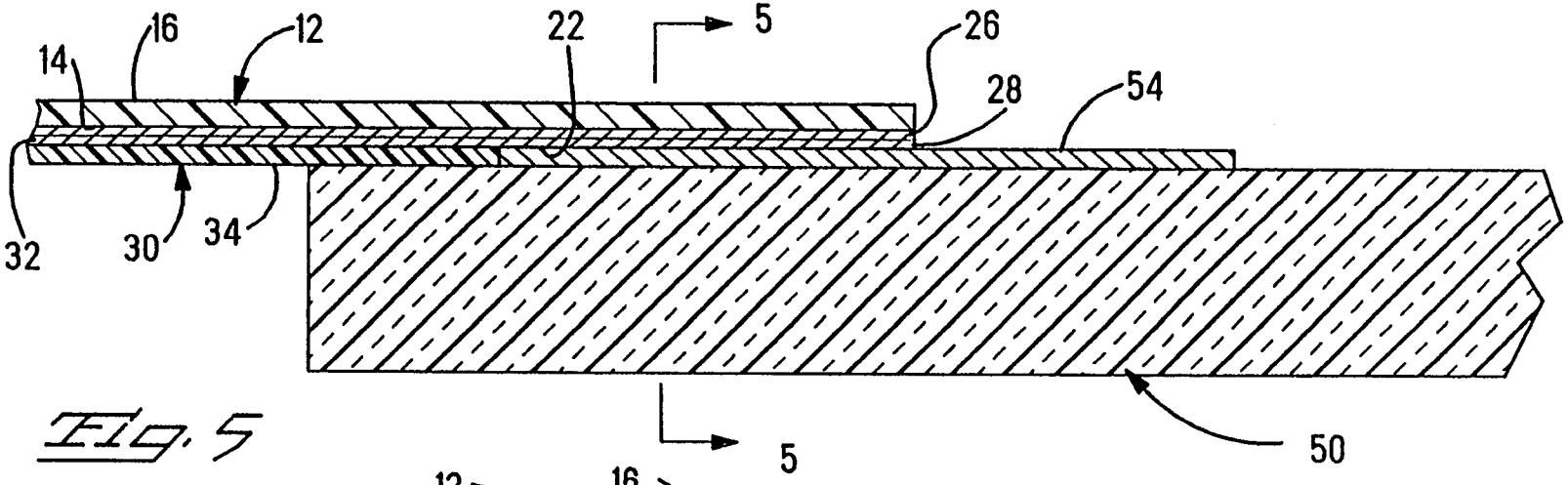
FIG. 5 is a fragmentary sectional view of the jumper cable assembly mounted to the circuit board.
Figure 6:
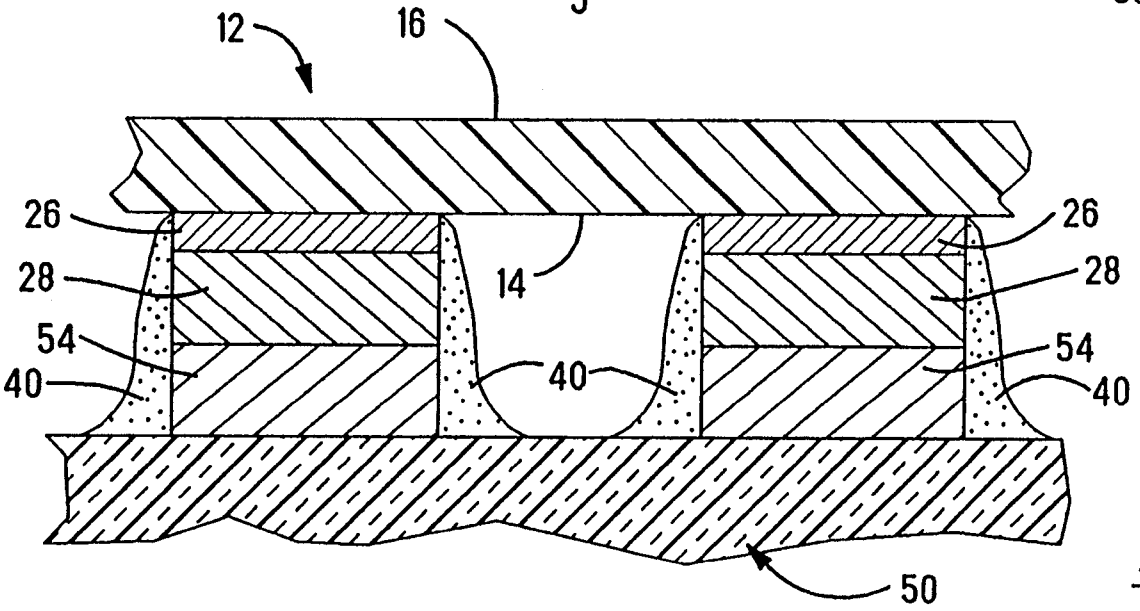
FIG. 6 is an enlarged fragmentary cross-sectional view taken along the line 5—5 of FIG. 4.

Referring now to FIGS. 1, 2, 3, 4, 5 and 6, the present invention includes at least a first layer 12 of insulating film, an array of electrical conductors 20 disposed on the first film layer 12, each conductor having first and second connecting portions at opposed ends thereof and a fusible electrically conductive material disposed on the first and second connecting portions. First film layer 12 has inner and outer major surfaces 14,16 respectively. Conductors 20 are disposed on the inner surface 14, each conductor having first and second connecting portions 22,24 at opposed ends thereof. Each conductor is formed from a first conductive layer 26 made of a first metal having a high electrical resistance and high magnetic permeability and a second metal layer 28 disposed on the first layer 26 and integrally joined thereto as best seen in FIG. 6. The second metal has a low electrical resistance and minimal magnetic permeability such as a copper, or copper alloy. The first conductive layer 26 has a thickness at least equal to one skin depth of the first metal, given a known frequency. Each of the conductors defines a heater body.

Figure 3:
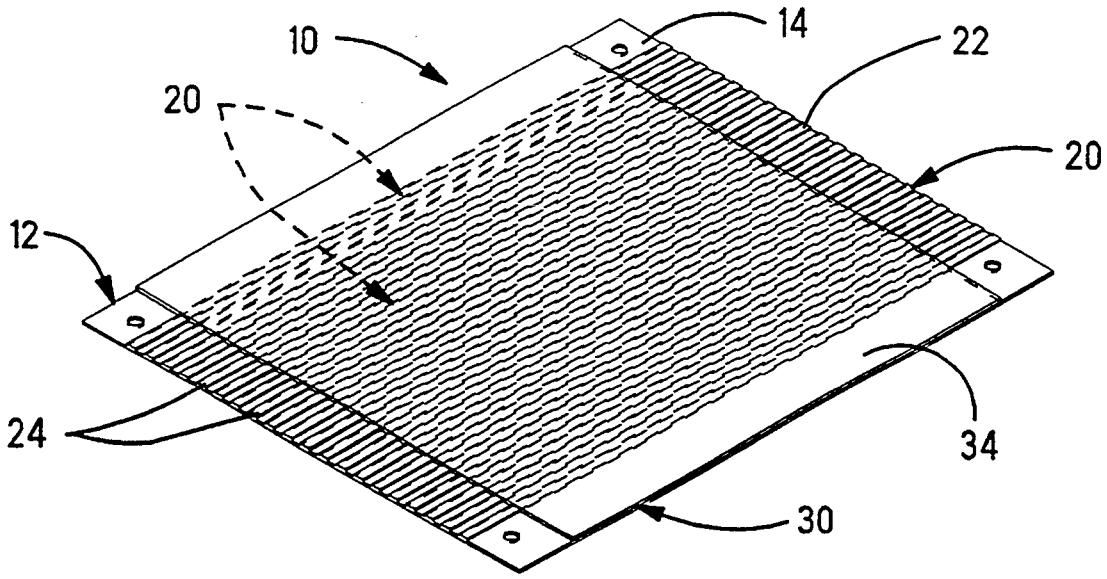
FIG. 3 is a view of the underside of the jumper cable illustrating the connecting portions of the conductors.

In another embodiment, a second layer 30 of insulating film, having opposed inner and outer major surfaces 32,34 respectively, is laminated to the first film layer 12 and the conductors 20 and lies adjacent the second conductive layer 28. The second film layer 30 is shorter in length than the first film layer 12 such that the second metal of the second layer 28 of the first and second connecting portions 22,24 respectively are exposed on the inner surface 14 of the first film layer 12. A fusible electrically conductive material 40 such as solder or the like is disposed on the exposed first and second connecting portions 22,24 respectively, is best seen in FIGS. 3, 4, and 6. The fusible electrically conductive material 40 may be solder or other known conductive material. It is to be understood that the second layer 30 of film may be used if it is desired to provide insulation over the conductor portions between the two connecting portions 22,24.

Figure 8:
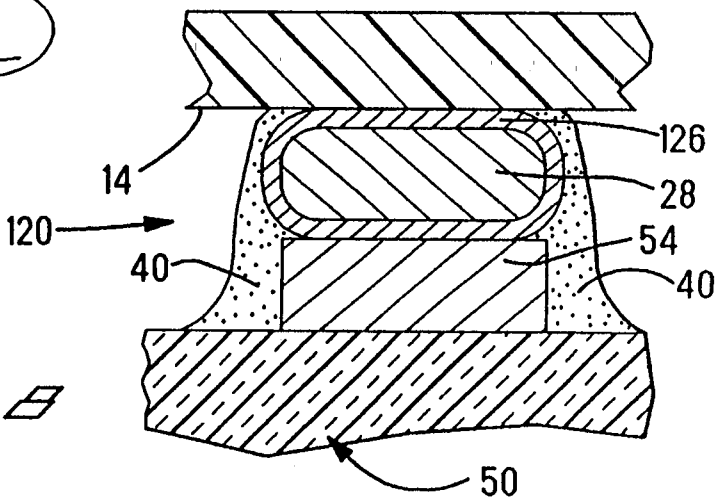
FIG. 8 is an enlarged fragmentary cross-sectional view similar to that of FIG. 6 and illustrating an alternative embodiment of the conductors.

FIG. 8 illustrates an alternative embodiment 120 of the conductors in which the conductors are formed as a wire having a core of the second metal 28 surrounded by an outer coating 126 of the first metal. To enhance solderability, a thin layer of tin (not shown) may be disposed on the exposed surfaces of the first and second connecting portions 22,24 prior to disposing the fusible electrically conductive material 40 thereon.

First conductive layer 26 is of a metal, which has high magnetic permeability and high resistance, the first layer for example being Alloy No. A-42 of nickel (42%) and iron (58%) and having a thickness of about 0.0005 inches or about 1½ to 2 times the thickness of a "skin depth" of the particular metal. Preferably the heater body of the invention is formed as a self-regulating heater as described in U.S. Pat. No. 5,059,756. The solder 40 of the two connecting portions 22,24 may be Sn 63 having a reflow temperature of about 183° C., and may have a thickness of about 0.001 inches.

The jumper cable assembly 10 as shown is designed to be used to join respective arrays of contact pads 54,64 on first and second electrical articles 50,60 such as circuit boards. As can be seen from FIGS. 1 and 2 a first electrical article or circuit board 50 has a plurality of contact pads 54 disposed on the upper surface 52 thereof and second electrical article, or circuit board 60 has a like array of contact pads 64 disposed on the upper surface 62 thereof. While the circuit boards 50,60 are shown as single layer circuit boards, it is understood that the circuit boards 50,60 may be multilayer boards with circuits having access to contact pads on the upper surface 52,62 respectively.

In a preferred embodiment, the film layers are made from a material such as a polyimide. One suitable material is available from E. I. dupont de Nemours and Co., Inc. under the trade name KAPTON. The jumper cable assembly 10 may be made by laminating an array of discrete conductors formed of the two layers 26,28 between the inner surfaces 14,32 of two film layers 12,30. Alternatively the conductors 20 may be formed on the inner major surface 14 of first film layer 12 by an etching process as known in the art.

Jumper cable assembly 10 may also include a plurality of alignment holes 44 at ends thereof adapted to be aligned with corresponding apertures 56 in the circuit board 30 to ensure that the conductors of the jumper cable are aligned properly with the contact pads 54 on circuit board 50. FIG. 1 also shows the use of an optional strain relief bar 70 having similar apertures 72 for aligning the strain relief bar 70 along the top edge of the cable assembly 10 after the interconnection has been completed.

Figure 7:
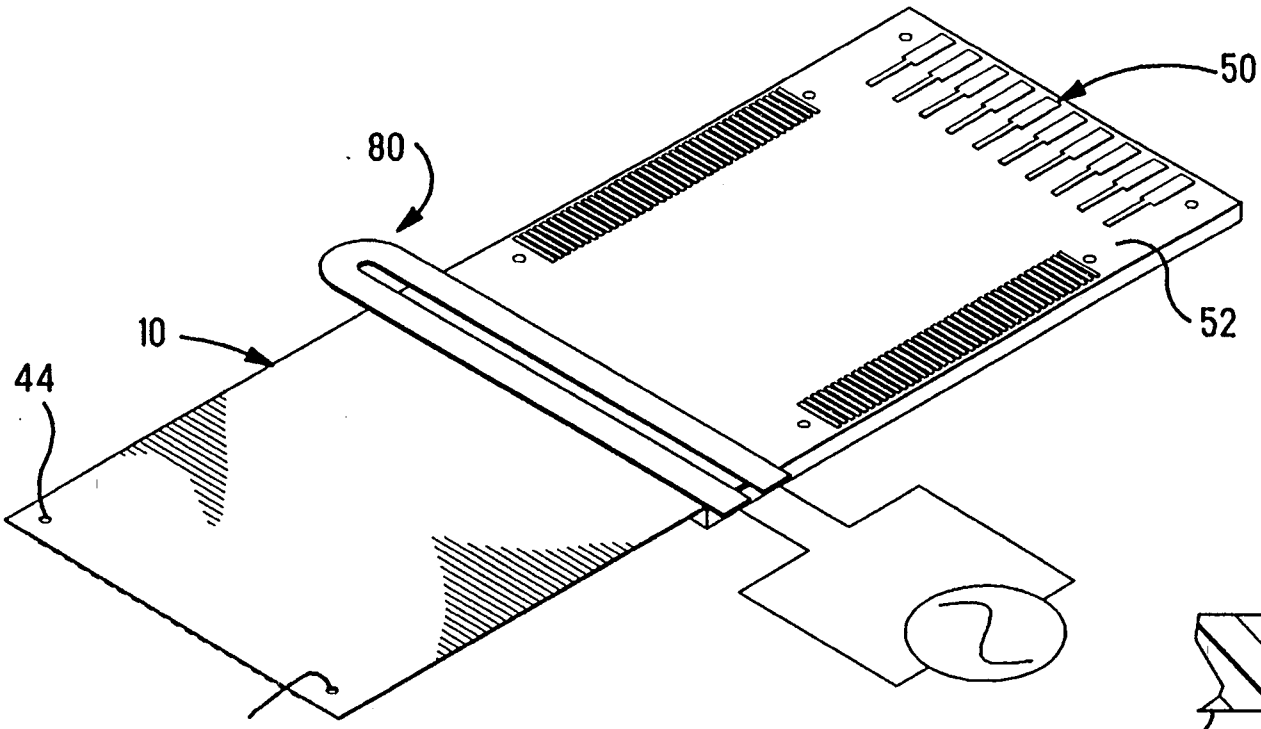
FIG. 7 is a top plan view of the assembly of FIG. 1 connected to the power source.

FIGS. 5, 6 and 7 illustrate the interconnection of the jumper cable assembly 10 to one of the circuit boards 50. Upon disposing the array of first connecting portions 22 over the corresponding contact pads 54 of these first electrical article 50 the fusible material 40 lies between the second connecting portion 22 and the contact pad 54. The conductors or heater body are subjected to a constant current of know frequency by means of an energizing coil 80 placed atop the outer surface 16 of the jumper cable assembly 10. Upon being subjected to the constant current each heater body generates and transfers sufficient thermal energy from the heater body to the connecting portion 22 to melt the fusible material 40 to electrically and mechanically interconnect the corresponding conductors 20 of the jumper cable assembly 10 to corresponding contact pads 54 of the first electrical article 50. The same procedure is used to interconnect the second connecting portion 24 to the corresponding array of contact pads 64 of the second electrical article 60. The generator currents in the energizing coil 80 induce eddy currents in the conductors 20 such that the heater bodies generate the thermal energy necessary to melt the fusible material. The fusing process takes about 10 to 15 seconds with a maximum temperature reached being that of the Curie temperature of the selective alloy of the first metal. Thus the first connecting portions 22 are electrically and mechanically interconnected to the corresponding contact pads 54 of the first electrical article 50.

It is thought that the jumper cable assembly of the present invention and many of its attendant advantages will be understood from the foregoing description. It is apparent that various changes may be made in the form, construction, and arrangement of the parts thereof without departing from the spirit or scope of the invention or sacrificing all of its material advantages.

We claim:

1. A jumper cable assembly for providing sufficient thermal energy to melt a fusible electrically conductive material and thereby provide electrically-conductive connections between an array of contact pads of a surface of a first electrical article to a corresponding array of contact pads on a surface of a second electrical article, usable in conjunction with a source of constant amplitude high frequency alternating current of known frequency, said jumper assembly comprising:

at least a first layer of insulating film having inner and outer major surfaces;

an array of electrical conductors disposed on said inner surface of said first film layer, each said conductor having first and second connecting portions at opposed ends thereof, each said conductor being formed from a first layer adjacent said first film layer, said first layer being a first metal having high electrical resistance and high magnetic permeability, said first conductor layer having a thickness at least equal to one skin depth of said first metal, given said known frequency, and a second conductor layer of a second metal integrally joined to said first conductor layer, said second metal having low electrical resistance and minimal magnetic permeability, each said conductor thereby defining a heater body; and fusible electrically conductive material disposed on at least said second metal layer of said first and second connecting portions of each conductor, whereby upon disposing said arrays of said first and second connecting portions of said conductors on corresponding arrays of contact pads of said first and second electrical articles with said second conductor layers adjacent respective said contact pads of said first and second electrical articles, and upon said heater bodies being subjected to said constant current of known frequency, each said heater body generates and transfers said sufficient thermal energy from said heater body to said connecting portions to melt said fusible material disposed therealong thereby electrically and mechanically interconnecting said conductors of said jumper cable assembly to corresponding contact pads of said respective first and second electrical articles.

2. The jumper cable assembly of claim 1 wherein said conductors are formed as a wire having a core of the second metal surrounded by an outer coating of the first metal.

3. A jumper cable assembly for providing sufficient thermal energy to melt a fusible electrically conductive material and thereby provide electrically-conductive connections between an array of contact pads of a surface of a first electrical article to a corresponding array of contact pads on a surface of a second electrical article, usable in conjunction with a source of constant amplitude high frequency alternating current of known frequency, said jumper assembly comprising:

a first layer of insulating film having inner and outer major surfaces;

an array of electrical conductors disposed on said inner surface of said first film layer, each said conductor having first and second connecting portions at opposed ends thereof, each said conductor being formed from a first layer adjacent said first film layer, said first layer being a first metal having high electrical resistance and high magnetic permeability, said first conductor layer having a thickness at least equal to one skin depth of said first metal, given said known frequency, and a second conductor layer of a second metal integrally joined to said first conductor layer, said second metal having low electrical resistance and minimal magnetic permeability, each said conductor thereby defining a heater body;

a second layer of insulating film having inner and outer major surfaces, said second film layer being disposed over said array of conductors such that said array of conductors lie between said inner surfaces of said first and second film layers, said second layer of film being secured to said first film layer and said conductors and adjacent said second conductor layer, said second film layer being shorter in length than said first film layer such that said second metal of said second layer of said first and second connecting portions of said conductors are exposed on the inner surface of said first film layer; and fusible electrically conductive material disposed on said exposed second metal layer of said first and second connecting portions of each conductor, whereby upon disposing said arrays of said first and second connecting portions of said conductors on corresponding arrays of contact pads of said first and second electrical articles with said second conductor layers adjacent respective said contact pads of said first and second electrical articles, and upon said heater bodies being subjected to said constant current of known frequency, each said heater body generates and transfers said sufficient thermal energy from said heater body to said connecting portions to melt said fusible material disposed therealong thereby electrically and mechanically interconnecting said conductors of said jumper cable assembly to corresponding contact pads of said respective first and second electrical articles.

4. The jumper cable assembly of claim 3 wherein said conductors are formed as a wire having a core of the second metal surrounded by an outer coating of the first metal.

5. A jumper cable assembly for providing sufficient thermal energy to melt a fusible electrically conductive material and thereby provide electrically-conductive connections between an array of contact pads of a surface of a first electrical article to a corresponding array of contact pads on a surface of a second electrical article, usable in conjunction with a source of constant amplitude high frequency alternating current of known frequency, said jumper assembly comprising:

at least a first layer of insulating film having inner and outer major surfaces; and an array of electrical conductors disposed on said inner surface of said first film layer, each said conductor having first and second connecting portions at opposed ends thereof, each said conductor being formed from a first layer adjacent said first film layer, said first layer being a first metal having high electrical resistance and high magnetic permeability, said first conductor layer having a thickness at least equal to one skin depth of said first metal, given said known frequency, and a second conductor layer of a second metal integrally joined to said first conductor layer, said second metal having low electrical resistance and minimal magnetic permeability, each said conductor thereby defining a heater body, whereby upon disposing fusible electrically conductive material on at least said second metal layer of said first and second connecting portions of each conductor and upon disposing said arrays of said first and second connecting portions of said conductors on corresponding arrays of contact pads of said first and second electrical articles with said second conductor layers adjacent respective said contact pads of said first and second electrical articles, and upon said heater bodies being subjected to said constant current of known frequency, each said heater body generates and transfers said sufficient thermal energy from said heater body to said connecting portions to melt said fusible material disposed therealong thereby electrically and mechanically interconnecting said conductors of said jumper cable assembly to corresponding contact pads of said respective first and second electrical articles.

6. The jumper cable assembly of claim 5 wherein said conductors are formed as a wire having a core of the second metal surrounded by an outer coating of the first metal.

* * * * *